United States Patent [19]

Elie

[11] 4,000,479

[45] Dec. 28, 1976

[54] SWITCHING MATRICES WITH CROSSED BARS FOR CO-ORDINATE SELECTION

[75] Inventor: André Elie, Paris, France

[73] Assignee: Metalimphy, Paris, France

[22] Filed: Jan. 27, 1975

[21] Appl. No.: 544,367

[30] Foreign Application Priority Data

Feb. 8, 1976 France ..... 74.04332

[52] U.S. Cl. ..... 335/112; 335/196; 200/175

[51] Int. Cl.[2] ..... H01H 67/14

[58] Field of Search ..... 335/112, 152, 196

[56] References Cited

UNITED STATES PATENTS

| | | | |
|---|---|---|---|
| 3,268,840 | 8/1966 | Hjertstrand | 335/112 |
| 3,646,303 | 2/1972 | Warman | 335/112 |
| 3,869,684 | 3/1975 | Grobe | 335/152 |

*Primary Examiner*—G. Harris
*Attorney, Agent, or Firm*—Cameron, Kerkam, Sutton, Stowell & Stowell

[57] ABSTRACT

A cross bar switching matrix for electric conductors in two sets has a first array of strips of magnetic metal mounted parallel on an insulating support plate with laterally projecting tongues from each strip the ends lying freely on the support plate. A second set of metal strips identical to the first set but at right angles thereto is mounted on a second insulating support plate. The support plates are juxtaposed with the strips perpendicular to each other and the free ends of the tongues of each set are opposed and form with a portion of each of the associated strips a ring which is substantially closed but for a thin layer of electrically insulating material in the areas where the strips of each array cross those of the other. Electromagnetic control circuits made up of electric control conductors are associated with a respective one of the strips and each electric control conductor includes a conductor linked with each of the rings formed by the tongues of the respective array strip.

4 Claims, 3 Drawing Figures

SWITCHING MATRICES WITH CROSSED BARS FOR CO-ORDINATE SELECTION

The present invention concerns switching matrices for co-ordinate selection used for the electric switching of conductors, and more particularly, as an example, to matrices of a command network of a space system of telephonic switching.

Matrices of crossing points for co-ordinate selection are already known in which the contacts at the crossing points are magnetic reed contacts in sealed envelopes; and such systems may use at the crossing points of two to four command coils, moreover this may be at each of the $n^2$ crossing points of a switching network for two arrays each of $n$ conductors.

There are also known systems of telephonic crossbar switching with electromechanical control, which use one coil per horizontal bar end and one coil per vertical bar for the closing of the contacts, which needs $2n$ coils for the network.

Another known arrangement combines the quality and speed of switching of the first system with the advantage of the smaller number of coils of the second system. In this system, the same strip of magnetic metal serves as the carrier for the control current and for the current in the switched network.

This arrangement has been described in French Patent Application No. 72–24835 dated July 3, 1972, in the conjoint name of SOCOTEL, CNET & CREUSOT-LOIRE.

In this last-mentioned arrangement, the number of crossing points that can be provided on a matrix is nevertheless limited by the magnetic leakages. In addition, its construction requires great accuracy in order to avoid cross-talk, and it is not efficient for interconnections of the "in conference" type, for which the same conductor of a network must be able to be connected simultaneously to several other conductors of another network.

The present invention overcomes the combined effect of the above inconveniences and provides matrices of the type with electromagnetically controlled crossing points of small bulk and low price, allowing co-ordinate control not requiring many control coils, and allowing simultaneous switching at several points on the same conductor.

According to the present invention there is provided a crossbar switching matrix for the selective connection, between electric conductors in two sets, said matrix comprising a first array of strips of magnetic metal, fixed parallel to each other on a first insulating support plate, each said strip being connected to a conductor of a first set of conductors and each having projecting laterally therefrom a series of tongues the extremities of which lie freely upon the support plate, a second set of metal strips, equal in number to the number of said tongues on each strip of the first set, fixed, also in a parallel array, on a second insulating support plate and each connected to a respective one of the conductors of the second set of conductors, and each having a plurality of laterally projecting tongues with free extremities, the number of said tongues being equal to the number of strips in the first array, the two support plates being juxtaposed with the faces carrying the strips facing each other so that the two arrays of strips are perpendicular to each other, and the free ends of the tongues of each set respectively, are opposed and form with a portion of each of the associated strips, a ring, substantially closed save for the interposition of a thin layer of electrically insulating material in the zones where the strips of each array cross those of the other, the ends of the tongues being without insulation, and including electromagnetic control circuits constituted by electric control conductors, each said control conductor being associated with a respective one of the strips of the arrays, and each electric control conductor being itself constituted by a conductor linked with each of the rings formed by the tongues of the respective array strip.

According to an embodiment of the invention each electric control conductor is a thin strip traversing successively each of the closed rings made by the tongues of the principal strip concerned, the control strip passing over the portion of the tongue or strip to enter the closed ring, then under it to leave, or vice versa, with the interposition of a thin layer of insulating material at the points at which it crosses the tongues or strips.

According to a preferred form of the invention, each control conductor is formed as a thin strip and is fixed on the same insulating support plate as and parallel to the respective principal strip and on the side thereof from which tongues extend, passing over the tongues with the interposition of a thin insulating layer at the crossing point.

The invention will now be described in more detail with reference to a particular embodiment, given by way of example, and shown in the drawings, of which;

Figure 1:
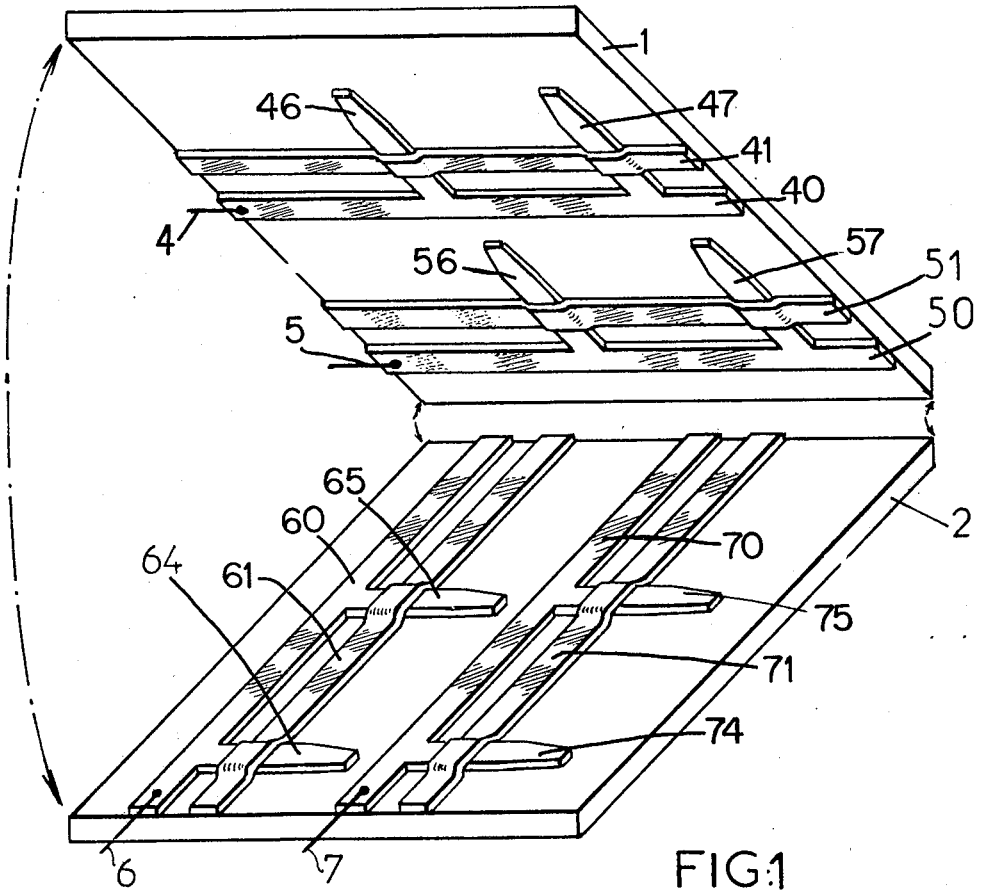
FIG. 1 is a perspective view of one element of the matrix having four crossing points; the two plates, constituting the matrix being shown separated from one another.

Referring to FIG. 1, the matrix of four interconnection points uses two insulating support plates 1 and 2 on each of which is fixed an array of conductors. In use, the two plates 1 and 2 are closed together as indicated by the chain line arrow in order to make a flat assembly.

The matrix is designed to connect selectively two by two, together or separately, one of the conductors 4 and 5 of one array with one of the conductors 6 and 7 of the second array. The conductor 6 is electrically connected to a thin strip 60, of magnetic metal, adhesively secured to the insulating plate 2. The strip 60 is furnished with small laterally extending tongues 64 and 65 likewise adhesively secured to the plate 2 in the neighbourhood of their junction with strip 60 but with their extremities free and therefore able to rise from the plate 2. A metal control strip 61 is disposed parallel to the strip 60 and adhesively secured to plate 2, passing over the tongues 64 and 65 a layer of an electrically insulating varnish is interposed between strip 61 and tongues 64 and 65 in the zones where they are juxtaposed. In a similar manner, conductor 7 is connected to a strip 70 which is furnished with tongues 74 and 75 and has a control strip 71 associated with it.

In the same fashion, insulating support plate 1 carries for each of two conductors 4 and 5, respectively, a strip 40 and 50 each of which is furnished with laterally extending tongues, and is associated with a control strip 41 and 51. The strips and tongues of the first group, carried by plate 2 are perpendicular to the strips and tongues of the second group carried by support plate 1. The arrangement of the various strips and tongues is such that when the two plates are brought together one upon the other, the free ends of the tongues face each other as shown in the pattern represented in FIG. 2.

An electrically insulting layer is interposed between the strips which come face to face when the plates are brought together, at least in the crossing zones indicated by shading in FIG. 1. On the other hand, the ends of the tongues are free of insulation. It can be seen, particularly in FIG. 2, that there are never more than two thicknesses of strip, that is to say, when they are brought together, the two plates are separated by a distance equal to twice the thickness of the strip material plus the thickness of the insulating layer which separates them. On the other hand the tips of the tongues are separated by a small clearance equal to the thickness of the insulating layer which separates the strips.

Figure 2:
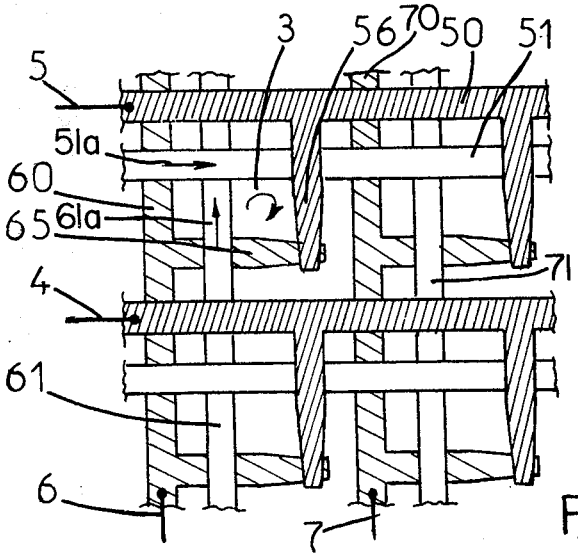
FIG. 2 is a partial schematic drawing illustrating the relative positions of the switched circuits and the control circuits.

It can be seen in FIG. 2, that at each place where a strip connected to a conductor of the first array crosses a strip connected to a conductor of the second array, for instance at the crossing of strips 50 and 60, the strips and the associated tongues form a closed ring, here constituted by a portion of strip 50, tongue 56, tongue 65, and a portion of strip 60. This ring forms a magnetic circuit having two gaps, one at the crossing of strips 50 and 60, formed by the interposed insulating layer, the other formed by the space between the two tongues 56 and 65.

Moreover, it can be seen that the control conductor strip 51 is linked with, that is, passes through, the ring above defined, in such a manner that, if a current is passed in the control conductor 51 in the direction of the arrow 51*a* shown in FIG. 2, the magnetic field produced by this current induces in the ring a magnetic flux circulating in the direction indicated by arrow 3. Similarly, if an electric current is passed through control conductor 61 in the direction of the arrow 61*a*, this current will induce in the ring a magnetic flux circulating in the same direction, again as shown by arrow 3. The intensities of the control currents passed through conductors 51 or 61 are chosen such that the flux induced by one control current alone will be insufficient to provoke the magnetic attraction of tips of the tongues and close the magnetic circuit. On the other hand, if control currents are passed in conductors 51 and 61 at the same time, the induced fluxes add together and cause mutual attraction between the tips of the tongues so that they make contact, which forms an electric connection between array strips 50 and 60, that is to say, between conductors 5 and 6.

Control conductor 51 also traverses the magnetic ring, energization of which results in contact between strips 50 and 70, so that when conductor 71 is not carrying a control current, contact between strips 50 and 70 is not established, but if it is desired to establish this contact at the same time as contact 50–60 it is sufficient to pass a control current through conductor 71 in the appropriate direction.

In the arrangement which has just been described, the magnetic fluxes induced by the currents are strictly limited to the ring corresponding to the contact it is desired to establish, provided that there are no magnetic leakages, and it is possible to obtain the closure of as many contacts as desired on the same array strip, by activating the control circuits of the crossbar conductors with which it is desired to make contact.

It is to be understood that the invention is not limited to a matrix of four pairs of contacts, as shown in the drawings for the purpose of simplification of the explanation. It is possible to make matrices containing practically any number of conductors that may be desired in either array of conductors, since the induced field is the same in each ring linked with each command conductor. A switching assembly has thus been provided for coordinate selection, which has a particularly small thickness, the active thickness being represented by the thickness of the metal strips forming the conductors plus the clearance between the tips of the contact tongues. Such a switching assembly has another advantage in that it can be made entirely by cutting thin metal strips, without any further work than the provision of a protective deposit in the zones where it is desired to insulate the strips electrically from one another.

It is possible to improve on this flat switching assembly by using, simultaneously, thin magnetic strips of high permeability and strips of magnetic material having a high coercive-force, the combination being used such as to provide a square rectangular hysteresis loop. This combination of materials provides control by pulses of small amplitude, with the contacts remaining engaged and a clearly determined threshold for disengagement.

It will be understood that the invention is not limited to the embodiment described in the example, but that it may be equally well carried out by other embodiments that differ only by variations of execution or by use of equivalent means. Thus, the control strips in which the control currents pass need not be strictly parallel to the strips carrying the circuits being switched; it is sufficient that the command strips traverse successively the rings formed by the tongues of the principal strip which they command and the tongues corresponding to the associated conductors. It would thus be possible to use command strips of zig-zag form provided that they enter a ring, for example over, and leave under, a strip or tongue or vice versa.

Figure 3:
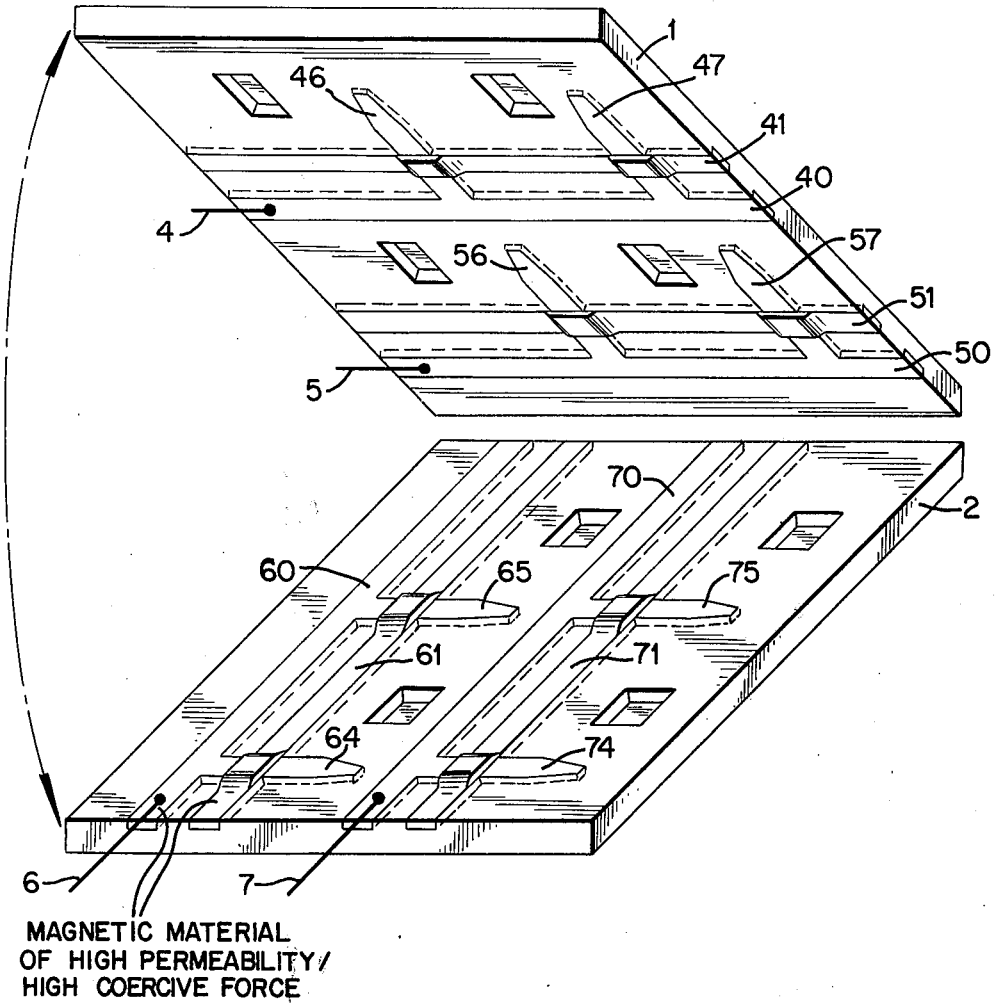
FIG. 3 is a perspective view of another embodiment of the present invention in which the strips and tongues are recessed in the support plates.

It will also be understood that the strips and tongues could be placed in slots in the supporting plates such as shown in FIG. 3 in a manner that the plates could be placed directly one against the other, recesses (not numbered) are provided in the face of each plate at the regions of the other plate where a control strip and a tongue are superimposed. Under these conditions the clearances would not be determined by the thickness of the insulation, which is relatively difficult to maintain constant, but by the depth of the slots, which can be formed with great precision by moulding.

I claim:

1. A cross bar switching matrix for the selective connection, between electric conductors in two sets, said matrix comprising a first array of strips of magnetic metal fixed parallel to each other on a first insulating support plate, each said strip being connected to a respective conductor of a first said set, and each having projecting laterally therefrom a series of tongues the extremities of which lie freely upon the support plate, a second set of metal strips, equal in number to the number of said tongues on each strip of the first set, fixed, also in a parallel array, on a second insulating support plate and each connected to a respective one of the conductors of the second set, and each having a plurality of laterally projecting tongues with free extremities, the number of said tongues being equal to the number of strips in the first array, the two support plates being juxtaposed with the faces carrying the strips facing each other so that the two arrays of strips are perpendicular to each other, and the free ends of the tongues of each set respectively, are opposed and form with a portion of each of the associated strips, a ring substantially closed save for the interposition of a thin layer of electrically insulating material in the zones where the strips of each array cross those of the other, the ends of the tongues being without insulation, and including electro-magnetic control circuits constituted by electric control conductors, each said control conductor being associated with a respective one of the strips of the arrays, wherein each said contol conductor is a strip passing successively through all successive rings formed by successive tongues of said respective strip by passing alternately over a portion of a ring and beneath another portion of said ring, with the interposition of an insulating layer at its crossings of the array strips of the tongues.

2. A switching matrix in accordance with claim 1 wherein each control conductor is fixed on the same insulating plate as the array strip with which it is associated, parallel to the array strip and on the same side of it as the tongues, passing over the tongues from which it is insulated by the interposition of an insulating layer at the crossings.

3. A switching matrix in accordance with claim 2, wherein the strips and tongues are recessed in their support plates in channels equal in depth to the thickness of the strips, recesses being provided in the face of each plate opposite to the regions of the other plate where a control strip and a tongue cross each other.

4. A switching matrix in accordance with claim 1 wherein strips of magnetic material of high permeability are used together with thin strips of magnetic material of high coercive force and having a rectangular hystereus loop.

* * * * *

UNITED STATES PATENT OFFICE

CERTIFICATE OF CORRECTION

Patent No. 4,000,479 Dated December 28, 1976

Inventor(s) Andre Elie

It is certified that error appears in the above-identified patent and that said Letters Patent are hereby corrected as shown below:

[30] Foreign Application Priority Data

"Feb. 8, 1976" should be --Feb. 8, 1974--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*